US005649578A

United States Patent [19]

Leguin

[11] Patent Number: 5,649,578

[45] Date of Patent: Jul. 22, 1997

[54] WOOD PULVERIZER WITH IMPROVED HAMMERS AND ANVILS

[76] Inventor: Dana Leguin, Rte. 4, Box 280, Summerville, Ga. 30747

[21] Appl. No.: 561,825

[22] Filed: Nov. 27, 1995

Related U.S. Application Data

[63] Continuation-in-part of Ser. No. 206,713, Mar. 7, 1994, Pat. No. 5,469,901.

[51] Int. Cl.[6] ..... B27L 11/02

[52] U.S. Cl. ..... 144/176; 144/162.1; 144/373; 144/241; 241/92; 241/225; 241/278.1; 241/286

[58] Field of Search ..... 144/162.1, 172, 144/174, 176, 369, 370, 373, 374, 375, 241; 241/92, 225, 278.1, 286

[56] References Cited

U.S. PATENT DOCUMENTS

| | | | |
|---|---|---|---|
| 1,195,774 | 8/1916 | Brown, Jr. . | |
| 1,418,735 | 6/1922 | Plaisted . | |
| 1,420,355 | 6/1922 | Williams . | |
| 2,034,951 | 3/1936 | McArdle et al. | 83/62 |
| 2,183,224 | 12/1939 | Norman | 144/176 |
| 2,655,319 | 10/1953 | Johnson | 241/92 |
| 3,732,907 | 5/1973 | Nystrom et al. | 144/176 |
| 3,746,062 | 7/1973 | Nystrom et al. | 144/176 |
| 3,801,027 | 4/1974 | Kubitz | 241/225 |
| 4,077,450 | 3/1978 | Ackerman | 144/172 |
| 4,109,690 | 8/1978 | Berg | 144/174 |
| 4,184,526 | 1/1980 | Hanaya | 144/235 |
| 4,444,234 | 4/1984 | Arasmith | 144/370 |
| 4,503,895 | 3/1985 | Arasmith | 144/373 |
| 4,569,380 | 2/1986 | Arasmith | 144/172 |
| 4,590,978 | 5/1986 | Kintz et al. | 144/174 |
| 4,610,928 | 9/1986 | Arasmith . | |
| 4,619,413 | 10/1986 | Wistuba | 241/286 |
| 4,736,781 | 4/1988 | Morey et al. | 144/176 |
| 4,771,953 | 9/1988 | Morey | 241/286 |
| 4,776,375 | 10/1988 | Arasmith | 144/241 |
| 4,785,860 | 11/1988 | Arasmith | 144/174 |
| 4,802,631 | 2/1989 | Arasmith | 241/88.1 |
| 4,827,989 | 5/1989 | Strong | 144/176 |
| 4,874,024 | 10/1989 | Arasmith | 144/174 |
| 4,958,775 | 9/1990 | Arasmith | 144/176 |
| 5,054,703 | 10/1991 | Morey | 241/296 |
| 5,469,901 | 11/1995 | Leguin | 144/176 |

*Primary Examiner*—W. Donald Bray
*Attorney, Agent, or Firm*—Isaf, Vaughan & Kerr

[57] ABSTRACT

An improved wood pulverizer is provided with a rotating disc studded with a plurality of curved tapered hammers. One or more anvils is secured to the pulverizer with the anvil having teeth and slots located adjacent the surface of the disc. The hammers of the rotating disc pass through the slots of the anvils as the disc rotates to tear and shard wood into bits and pieces for subsequent use or processing. The anvils of the present invention are formed with two or more useable surfaces so that the anvils can be removed, rotated, and replaced to present fresh cutting surfaces to the disc. Further, the anvils are formed by a series of bolted together anvil segments to allow replacement of only single segments in the event of damage.

8 Claims, 3 Drawing Sheets

WOOD PULVERIZER WITH IMPROVED HAMMERS AND ANVILS

REFERENCE TO RELATED APPLICATION

This application is a continuation-in-part of my U.S. application Ser. No. 08/206,713, filed Mar. 7, 1994, now U.S. Pat. No. 5,469,901.

TECHNICAL FIELD

This invention relates generally to wood and log processing machinery and more particularly to wood hogs and chippers for shredding wood into chips and shards for subsequent use or disposal.

BACKGROUND OF THE INVENTION

Cylindrical drum-type wood chippers for reducing logs, branches, roots, and the like to wood chips are well known. In general, drum-type chippers comprise a rotating cylindrical drum having an exterior surface studded either with hammers or sharpened chipper knife blades depending upon the desired consistency of the finished chips. Sharpened chipper blades, for example, tend to produce neatly cut wood chips while hammers tend to pulverize, shred, and tear the wood into randomly shaped shards. In use, logs and branches are fed to the rotating drum where the moving hammers or knives reduce them into small pieces that can be transported easily or be used for pulp, mulch, or the like.

Examples of drum type wood chippers are found in U.S. Pat. Nos. 4,802,631 of Arasmith, 4,785,860 of Arasmith, 1,418,735 of Plaisted, and 3,801,027 of Kubitz. In most of these examples, logs to be processed are fed to the surface of the rotating drum by a feeder mechanism such as a conveyor or feed roll. The blades of the drum are configured to impact, cut, and chip the log into pieces of roughly the same size, whereupon the pieces are discharged from the machine through a discharge chute.

Disc chippers have been developed as an alternative to drum type chippers. These disc chippers employ a rotating knife or hammer bearing disc rather than a cylindrical drum to reduce wood to chips. A good example of a disc chipper is presented in U.S. Pat. No. 4,827,989 of Strong. Other examples are illustrated in U.S. Pat. Nos. 1,195,774 of Brown, 3,732,907 of Nystrom, and 4,736,781 of Morey et al. In addition, a unique and improved disc type chipper is disclosed and claimed in my own U.S. Pat. No. 5,469,901, of which the present application is a continuation-in-part. The disclosure of my said patent is hereby incorporated by reference in order to provide a good background for the particular improvements and disclosures of the present application.

In general, disc type chippers comprise a housing that carries a rapidly spinning metal disc having knives or hammers mounted on the surface of the disc. Wood to be processed is fed to the disc surface, usually at an angle, where the knives or hammers reduce the wood to chips and shards. The chips and shards, when cut, can either pass through gullets in the disc, can be discharged through a sizing grate, or can be transferred to the back side of the disc for additional processing.

Many disc-type chippers and drum-type chippers have moving surfaces that are studded with hammers or knives that protrude outwardly from the surface. In the case of disc-type chippers having hammers, these hammers usually comprise a rectangular block of metal that is secured with screws or weld joints to the surface of the disc so that the hammers protrude therefrom. Usually, the hammers are arranged along preselected radii of the disc so that they can pass through slots formed in metal anvils that are secured adjacent to the surface of the disc. The interactions of the hammers and anvils generates a scissor action that shreds and cuts the wood into small pieces and shards that can be subsequently processed or discharged from the machine. Typically, as disclosed in my U.S. Pat. No. 5,469,901, the anvil of a disc chipping machine is located at the base of an infeed spout so that wood, usually in the form of tree limbs, is presented directly to the hammer/anvil interface as it is fed into the machine. In this way, the wood that is introduced through the infeed spout is immediately shredded and torn by the scissor action of the interacting of the hammers and anvil.

In the past, hammers such as those just discussed have generally been rectangular and have been formed of a single piece of hardened steel having square transverse grooves cut in one edge thereof. While this has proved somewhat acceptable for shredding and cutting wood, it nevertheless is plagued with various problems and shortcomings. For example, in disc-type chippers, a relatively large clearance must be provided in the anvil so that the rectangular hammers, which are actually traveling in circles, can pass through the slots in the anvil without engaging the sides thereof. This problem is particularly acute at positions nearest the hub of the disc, where the arc through which the hammers travel is the tightest. An additional problem with prior art wood chippers and hogs has been that the anvils generally are made of a single solid piece of hardened steel that is securely fastened to the frame of the machine adjacent to the rotating disc thereof. Such monolithic anvil designs, which have been relatively simple to manufacture, are nevertheless plagued with their own problems. For example, occasionally a stone or piece of metal will inadvertently be fed into the machine. Such foreign items can cause teeth of the anvil to be broken off when they encounter the interface between a moving hammer and an anvil slot. Broken anvil teeth reduce the efficiency of the entire machine and require that the anvil be replaced. In addition, anvils in wood chippers and wood hogs tend to wear at different rates along their length as a function of the distance along the anvil from the hub of the chipper. Accordingly, in some instances, the entire anvil must be replaced when only a portion of it is worn beyond use. Obviously, this is expensive and wasteful.

It will thus be seen that there exists a continuing need for a wood pulverizing machine such as a chipper or hog having improved hammer and anvil configurations designed to enhance the efficiency and function of the machine. Such hammer and anvil configurations should assure minimum clearance between the walls of the anvil slots and the hammers passing through to maximize the scissor-like action that shreds wood into chips and shards within the machine. In addition, an improved anvil design should permit placement of the anvil adjacent a hammer-bearing disc in any one of a variety of orientations relative to the radius of the disc to improve efficiency. Further, the anvil should be assembled in replaceable segments so that broken teeth of an anvil can be replaced without replacing the entire anvil. It is to the provision of a wood pulverizing machine having such improved hammer and anvil configurations that the present invention is primarily directed.

SUMMARY OF THE INVENTION

Briefly described, the present invention comprises a wood pulverizing machine such as a disc hog having greatly improved hammers and anvil configurations for providing more efficient and effective pulverization of wood such as limbs and the like. The improved hammer and anvil designs of the present invention are primarily intended for use with disc hogs; however, the concepts disclosed and claimed herein are also applicable to drum chippers having cylindrical drums with hammer studded surfaces.

In one embodiment, the present invention comprises an anvil/hammer combination wherein the hammers are curved to correspond roughly to the radius of curvature at the location of the hammer on the disc. Correspondingly, the slots formed in the anvils, through which the hammers pass, are curved to correspond to the curvature of the hammers. In this way, the space between the moving hammers and the slots in the anvils can be minimized to increase the pulverizing efficiency of the machine. The improved anvils of the present invention have slots formed to accommodate anvils positioned either along a radius or skewed relative to a radius of the disc, even to the point of being perpendicular to a radius.

Preferably, the anvils of this invention have one or more useable edges or surfaces so that the anvil can be removed and turned over or repositioned to present fresh slots and cutting surfaces to the hammers and the disc of the machine. In this way, the anvil, when worn, can simply be turned over to present a fresh cutting edge, thus prolonging the life of the anvil.

In one preferred embodiment, the anvil is formed from a series of anvil segments bolted together to form the elongated anvil. With this embodiment, if one tooth of the anvil should become broken or unacceptably worn, only the single anvil element requires replacing, thus increasing the efficiency and economy of the machine as a whole. Each anvil segment is formed with a tooth and a shoulder that aligns with the shoulder of an adjacent anvil segment to define a slot through which a moving hammer can pass. The anvil segments have alignment means so that they are automatically aligning when secured together to form the entire anvil.

The invention further comprises an improved disc hog-type wood chipper having a first anvil aligned along a first predetermined orientation relative to the disc radius and a second anvil oriented along a second predetermined orientation. In the preferred embodiment, the anvils are aligned along a radius and perpendicular to a radius on the bottom and side of the infeed spout. In this way, the shredding, tearing, and pulverizing process is greatly enhanced over prior art designs.

Thus, it is an object of the invention to provide an improved hammer and anvil design useable in conjunction with a wood pulverizing machine to increase the efficiency of the machine.

It is another object of the invention to provide an improved anvil design for use with a wood pulverizing machine wherein the anvil has at least two useable surfaces for increased anvil life.

An additional object of the invention is to provide an improved anvil for use with a wood pulverizing machine wherein the anvil is formed of a series of anvil segments interconnected together so that individual segments can be removed and replaced if desired.

Another object of the invention is to provide an improved design for hammers useable with a disc hog-type wood pulverizing machine wherein the hammers are curved to correspond to a radius of the disc and wherein the slots formed in the anvil are also curved to accommodate the curved hammers.

A further object of the invention is to provide an improved disc hog-type wood pulverizing machine having at least two anvils oriented along selected perimeters of the machines infeed port to provide increased wood pulverizing efficiency.

These and other objects, features, and advantages of the invention will become more apparent upon review of the detailed description set forth below taken in conjunction with the accompanying drawings which are briefly described as follows.

DETAILED DESCRIPTION OF THE PREFERRED EMBODIMENT

Figure 1A:
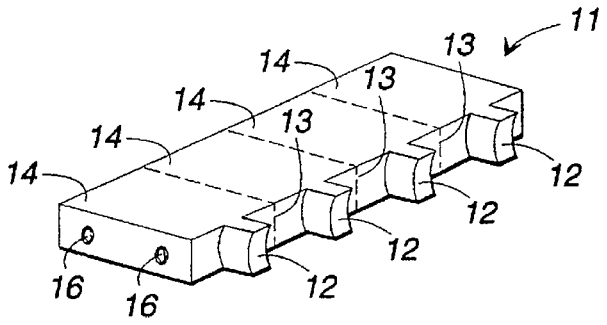
FIG. 1A is a perspective view of an improved anvil that embodies principles of the preset invention in a preferred form.

Referring now in more detail to the drawings, in which like numerals refer to like parts throughout the several views, FIGS. 1A through 1D illustrate anvils for use with disc hog-type wood chippers with the anvils embodying principles of the present invention in preferred forms. FIG. 1A illustrates a simple one-sided anvil formed with curved teeth and slots to accommodate the passage of hammers on an adjacent rotating disc. The anvil 11 has an elongated generally rectangular shape with a series of protruding teeth 12 formed along one edge thereof. Separating the teeth 12 are a set of slots 13. As described in more detail below, the anvil 11 is adapted to be mounted to a disc hog-type wood pulverizing machine with its teeth 12 extending toward the surface of the rotating disc of the machine and with its slots 13 positioned so that hammers protruding from the surface of the disc pass through the slots. The action of the hammers and slots functions to tear and shred wood into chips and shards for subsequent processing or other use.

The anvil 11 in FIG. 1A is also seen to be formed by a series of anvil segments 14. The segments 14 are aligned edge to edge and are secured firmly together by a pair of bolts 16 to form a substantially monolithic anvil structure.

Formation of the anvil 11 from a series of anvil segments permits easy and economic replacement of single segments in the event that the tooth associated with a segment becomes broken, damaged, or worn beyond use. This represents a benefit over prior art anvils made of a single piece of metal wherein the entire anvil must be replaced if any portion thereof is damaged.

Figure 1B:
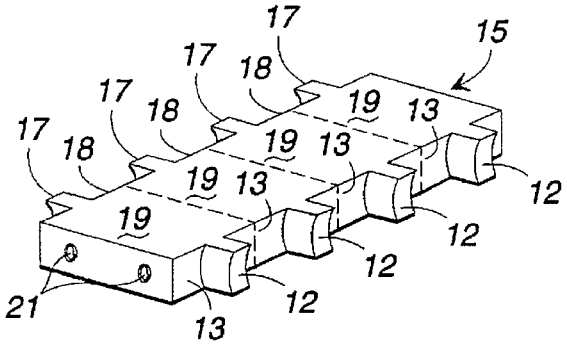
FIG. 1B is illustrates an alternate embodiment of the anvil of FIG. 1A illustrating an anvil with two useable edges.

FIG. 1B illustrates an anvil with teeth and slots formed along two opposed edges thereof. Specifically, a series of teeth 12 are formed along one edge defining slots 13 therebetween and a corresponding series of teeth 17 defining slots 18 are formed along the opposed edge of the anvil 15. As with the embodiment of FIG. 1A, the anvil of FIG. 1B is also formed by a series of side by side anvil segments 19 that are bolted together with a pair of bolts 21. With the embodiment of FIG. 1B, should the teeth and slots on one edge become worn or broken, the entire anvil 15 can be removed, rotated 180 degrees, and reinstalled to present fresh teeth and grooves to the rotating disc of a disc hog machine. Alternatively, if one of the teeth on one edge of the anvil should become broken, the anvil can be removed, disassembled, and the affected segment rotated 180 degrees. The anvil can then be reinstalled so that a fresh tooth is presented in place of the broken tooth. Should both teeth of a particular segment become broken or worn beyond use, it is only necessary to replace one segment rather than the entire anvil to bring the machine back to operating standards.

Figure 1C:
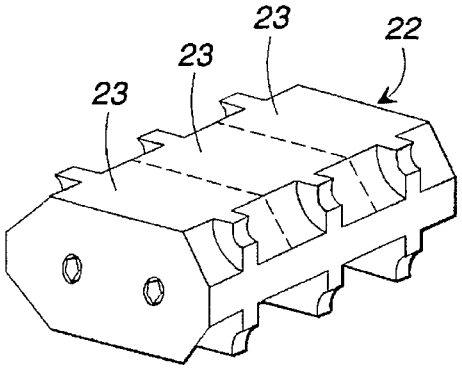
FIG. 1C is a perspective view of an anvil embodying principles of the present invention and intended for use with a drum-type wood chipping machine.

FIG. 1C illustrates an anvil for use with a rotating drum-type wood pulverizing machine. With this embodiment, the anvil 22 is formed from a series of bolted together anvil segments 23. The segments are formed so that, when they are bolted together, they define four sets of teeth and slots that can be presented to the surface of a rotating drum to accommodate the passing hammers or knives on the drum. With this embodiment, should a set of teeth become worn or broken, the anvil can be rotated and reinstalled with a fresh set of teeth presented to the drum. This can be done up to three times. In addition, individual segments can be removed and replaced or rotated if necessary to present fresh teeth and slots to the rotating drum surface.

Figure 1D:
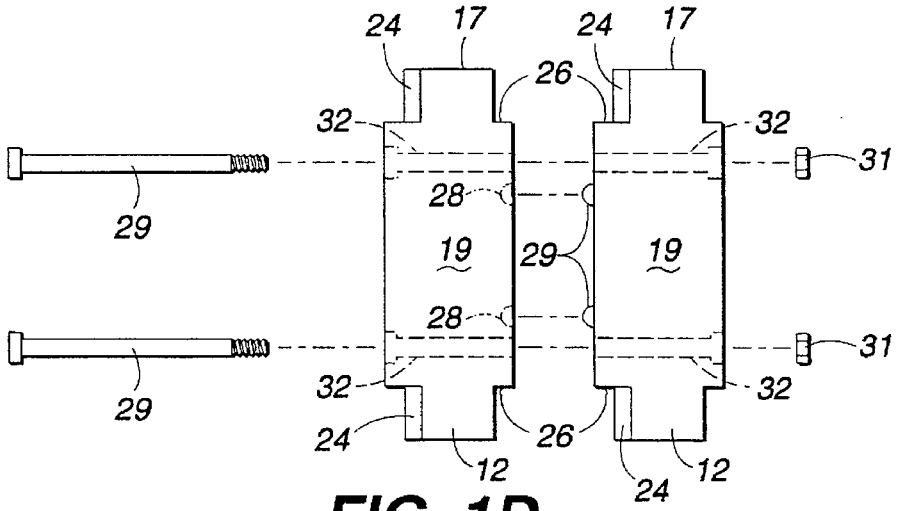
FIG. 1D illustrates formation of an anvil of the present invention from anvil segments connected together with bolts.

FIG. 1D illustrates one preferred method of securing anvil segments together to define an anvil. The embodiment shown in FIG. 1D corresponds to the anvil shown in FIG. 1B; however, it will be understood that the configuration illustrated in FIG. 1D is applicable to any of the other anvil designs disclosed in this application. Each of the anvil segments 19 is formed with a tooth 17 on one end and an opposing tooth 12 on the other end. The teeth 12 and 17 are curved to accommodate a moving hammer of a rotating disc and the curved protruding sides of the teeth are visible at 24. The teeth 12 and 17 define shoulders 26. When two segments 19 are secured together as illustrated in FIG. 1B, the shoulders 26 of adjacent segments along with the walls of adjacent teeth form the slots 13 and 18 between the teeth as shown in FIG. 1B.

A pair of alignment pins 27 are formed along one edge of segment 19. The alignment pins 27 are sized and positioned to be received in a pair of corresponding alignment dimples 28 formed in the facing edge of the adjacent anvil segment 19. In this way, when two segments 19 are brought together, they are automatically aligned with each other by means of the alignment pins 27 and dimples 28.

Pairs of through bores 32 are formed in the segments and are positioned to align with each other and to receive a pair of bolts 29 and nuts 31 for securing the two segments together side by side to define a composite anvil. Naturally, in use, several of the segments 19 would be bolted together to form a long anvil having a series of teeth and slots. Only two anvil segments 19 are illustrated in FIG. 1D for clarity and simplicity of discussion.

Figure 2:
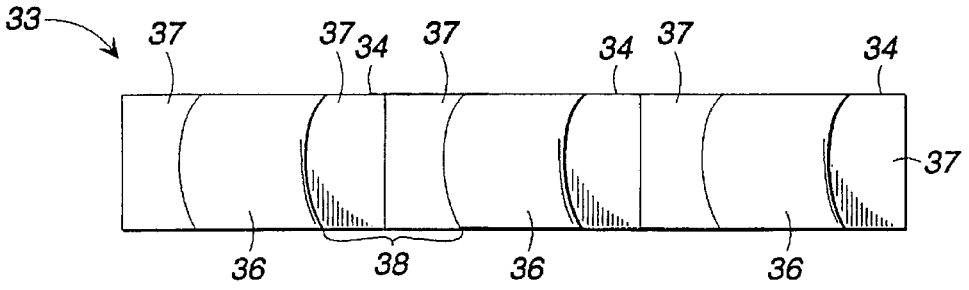
FIG. 2 is an edge elevational view illustrating the curved teeth and slots formed in an anvil designed to be oriented along a radius of a disc hog.

FIG. 2 is a side elevational view of an anvil that embodies principles of this invention in a preferred form. The anvil 33 is seen to be formed from a series of bolted together anvil segments 34. Each segment 34 has a protruding tooth 36 and a pair of shoulders 37 that, in conjunction with the shoulders of adjacent segments, define slots 38 between adjacent teeth 36. The teeth 36 and therefore the slots 38 are curved in order to accommodate the circular path take by a hammer on a rotating disc of a disc hog-type wood pulverizer. In the embodiment of FIG. 2, the anvil 33 is adapted to be oriented substantially along a radius of the disc. Thus, the curvature of each tooth corresponds to the radius of curvature of the disc at the position where the tooth is located. With the curved teeth and curved slot configuration shown in FIG. 2, a much closer clearance can be provided between a moving hammer and the slot through which it passes to enhance the efficiency of the wood pulverization process.

Figure 3:
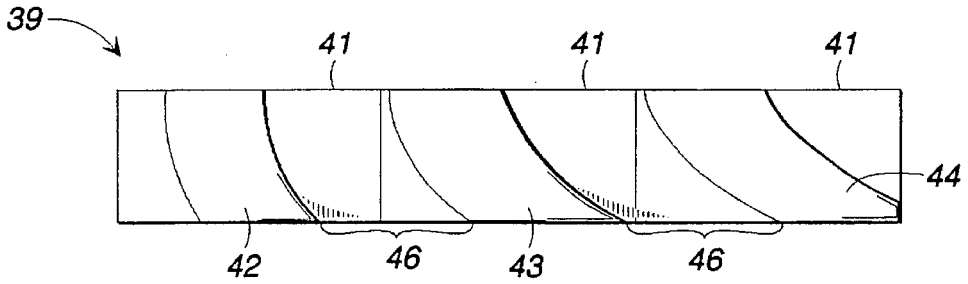
FIG. 3 is a side elevational view of an anvil adapted to be positioned in a skewed orientation relative to a radius of a wood chipper disc.

FIG. 3 illustrates an anvil that embodies principles of the present invention and that is designed to be oriented at a skewed angle relative to a radius of a rotating disc with which the anvil is used. As with previous embodiments, the anvil 39 is formed by a series of bolted together anvil segments 41. Each segment is formed with a tooth 42, 43, and 44 respectively. Since the anvil 39 of FIG. 3 is adapted to be positioned in skewed relationship with respect to a radius of its associated rotating disc, the teeth 42, 43, and 44 are progressively skewed to correspond to the radius of curvature at the position on the disc where the tooth is located. With this configuration, the slots 46 defined between the teeth 43 and through which the hammers on the rotating disc pass, are also progressively skewed to accommodate the path of the moving hammers on the disc.

Figure 4A:
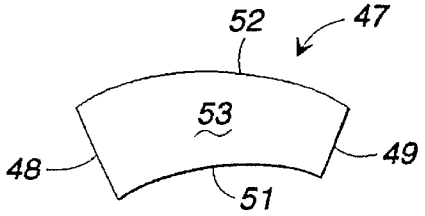
FIGS. 4A through 6B illustrate various improved hammer designs for use with disc hog-type wood pulverizing machines.
Figure 4B:
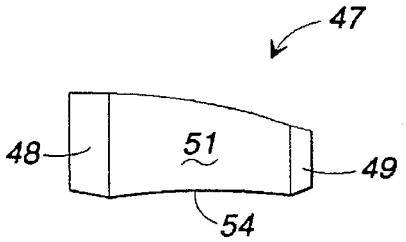

FIGS. 4A and 4B illustrate from the top and side respectively, one configuration of a hammer for use with a corresponding anvil of the present invention. The hammer 47 is seen to have a front surface 48, a rear surface 49, an inner side surface 51, an outer side surface 52, and a top surface 53. The hammer 47 is adapted to be secured at its base 54 to the disc of a disc hog-type wood pulverizing machine with appropriate attachment means such as a bolt or by welding. The hammer 47 of FIGS. 4A and 4B is seen to be inwardly tapered from side to side and along its top from its front surface 48 to its back surface 49. In addition, the hammer 47 is curved to correspond to the radius of curvature at the position on the disc where the hammer is to be located. The size of the front surface 48 of the hammer 47 is selected to be just smaller than the size of a slot 38 (FIG. 2) in an associated anvil so that the clearance between the moving hammer and the slot is small. The curved and tapered shape of the hammer 47 accommodates the movement of the hammer through the slot and further enhances the scissor action as the front surface 48 of the hammer passes through the slot 38.

Figure 5A:
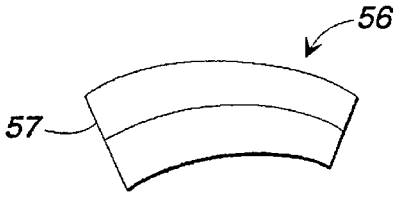
Figure 5B:
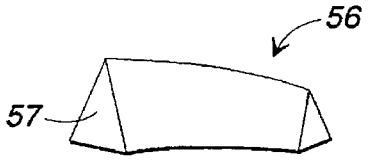

FIGS. 5A and 5B illustrate an alternate hammer having a triangular configuration. As with the hammer of FIGS. 4A and 4B, the triangular hammer 56 has a curved tapered configuration with a triangular shaped front surface 57. The hammer of FIGS. 5A and 5B is for use in conjunction with an anvil having triangular shaped slots formed between corresponding teeth.

Figure 6A:
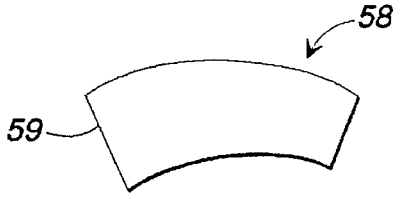
Figure 6B:
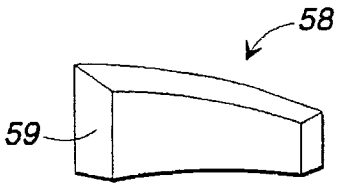
Figure 7A:
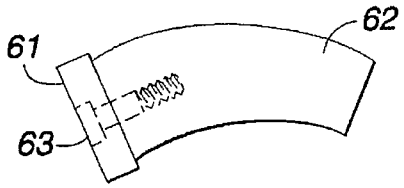
FIGS. 7A through 9B illustrate alternate embodiments of hammers designed for use with disc hog-type wood pulverizing machines.
Figure 7B:
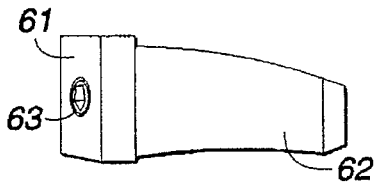
Figure 8A:
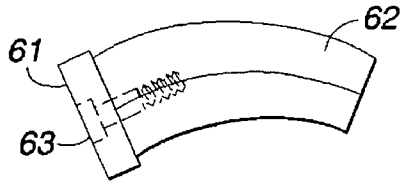
Figure 8B:
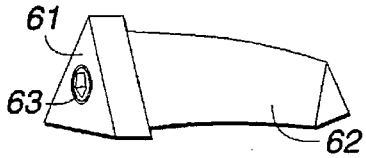
Figure 9A:
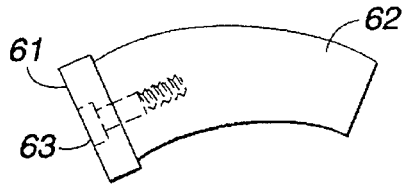
Figure 9B:
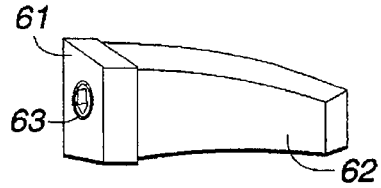

FIGS. 6A and 6B illustrate still another embodiment of a hammer 58 wherein the front surface 59 of the hammer has a trapezoidal shape, being taller along the outside edge of the hammer than along the inside edge of the hammer. As with the previously discussed hammers, the hammer of FIGS. 6A and 6B is curved and tapered and is intended to be used with a corresponding anvil having slots that match the trapezoidal shape of the front surface of the hammer.

FIGS. 7A through 9B illustrate alternate embodiments of the hammers shown in FIGS. 4A through 6B respectively. The function of these hammers is the same as that of the previously described hammers except that the hammers of FIGS. 7A through 9B each comprise a body that is welded to the rotating disc and a removable front surface that can be made of carbon steel or other hard material. The advantage of the hammers of FIGS. 7A through 9B is that the front or cutting surface of the hammers can be replaced if worn or broken. Each of the front or cutting surfaces 61 is secured to its corresponding hammer body 62 by means of a bolt 63. With this embodiment, the hammer body 62 can be permanently fixed to the disc with weld joints so that only the front or cutting surfaces 61 need to be replaced when worn.

Figure 10:
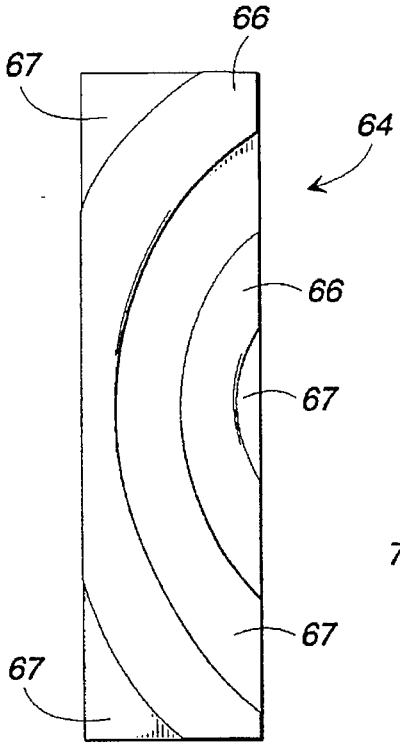
FIG. 10 is an edge elevational view of the teeth and grooves of an anvil adapted to be oriented perpendicular to the radius of a disc hog disc.

FIG. 10 is an edge elevational view of an anvil 64 adapted to be oriented along a line perpendicular to a radius of the rotating disc of a disc hog-type wood pulverizing machine. In this embodiment, the teeth 66 and corresponding slots 67 are seen to be configured to accommodate the hammers on the rotating disc when the anvil is oriented perpendicular to a radius. Obviously, any configuration of hammers and slots between the configuration shown in FIG. 2 and that shown in FIG. 10 is possible, depending upon the position where an anvil will be located and the orientation of the anvil relative to a radius of the disc.

Figure 11:
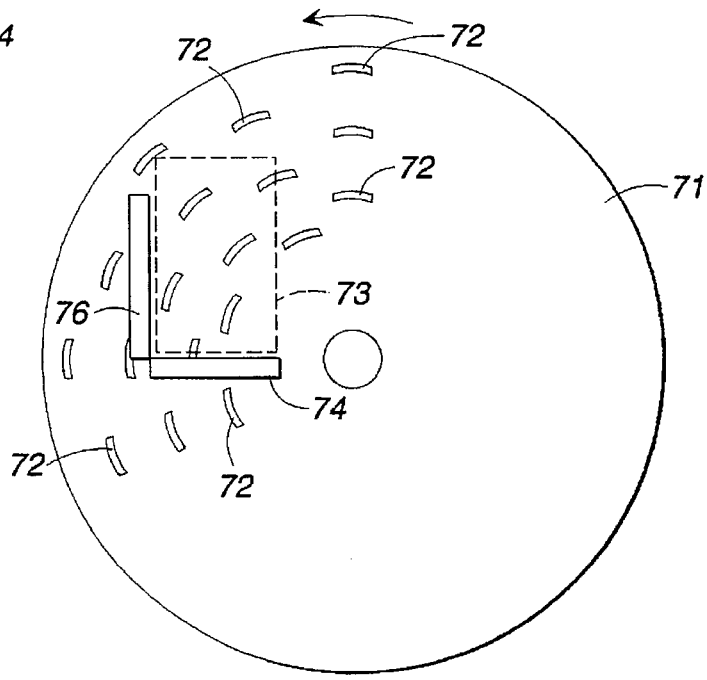
FIG. 11 illustrates an improved disc hog-type wood pulverizing machine having curved hammers and two anvils oriented along selected perimeters of the infeed spout of the machine.

FIG. 11 illustrates a wood pulverizing machine in the form of a disc hog that embodies principles of the present invention in a preferred form. For simplicity, only the disc, hammers, anvils, and infeed spout are shown in FIG. 11. Other functional components of a disc hog-type wood pulverizing machine, such as the housing, are illustrated in my U.S. Pat. No. 5,469,901 and are well known in the art. In FIG. 11, the rotating disc 71 of the disc hog pulverizing machine is see to be studded with a plurality of protruding hammers 72 arrayed about its hub. The hammers 72 can take on any of the configurations illustrated in FIGS. 4A through 6B or FIGS. 7A through 95 or can take on other configurations according to the intended use of the machine. An infeed spout 73 is indicated in phantom lines in FIG. 11. In use, the infeed spout would be mounted to the front wall of the housing of the disc hog and would provide a feeder opening through which limbs and other lumber to be pulverized could be inserted.

A first anvil 74 is mounted to the housing of the machine at the base of the infeed spout 73. In the embodiment of FIG. 11, the anvil 74 is oriented substantially along a radius of the disc and thus would have teeth and slots shaped substantially as shown in FIGS. 1A, 1B, and 2. The slots formed in the anvil 74 are positioned to accommodate the hammers 72 which pass through the slots to shred and shard the wood as previously described.

A second anvil 76 is positioned along one side of the infeed spout 73 and is oriented substantially perpendicular to a radius of the disc 71. As with the anvil 74, the slots and teeth formed in the anvil 76 are positioned and oriented to accommodate the movement of the hammer 72 past the anvil 76 and through the slots formed therein. With the embodiment of FIG. 11, as wood in the form of limbs or otherwise, is fed into the infeed spout 73, it is engaged by the hammer 72, which tears and cuts the wood against both the radially oriented anvil 74 and the perpendicularly oriented anvil 76. The efficiency of the pulverization process is thus enhanced by the addition of a second anvil oriented ar right angles with respect to the first anvil. Clearly, a third anvil could also be added along the other side of the inlet spout 73 and other anvils could be added as desired around the periphery of the rotating disc 71 to further tear and shard the wood as it is carried about the disc.

The invention has been described herein in terms of preferred embodiments. It will be obvious to those of skill in the art, however, that various modifications, additions, and deletions might well be made to the embodiments illustrated herein without departing from the spirit and scope of the invention as set forth in the claims.

I claim:

1. An apparatus for reducing wood to chips and shards for subsequent processing or disposal, said apparatus comprising:

a housing having a front wall formed with an infeed spout through which wood to be processed can be introduced into said housing;

a disc disposed in said housing with said disc being mounted for rotation about its central axis;

said disc having a front surface disposed in spaced relationship with said front wall of said housing;

said infeed spout having a base and edges and being located on said front wall of said housing to present wood to said front surface of said disc as said disc rotates in said housing;

a plurality of hammers protruding from said front surface of said disc extending toward said front wall of said housing;

a first anvil secured to said housing, said first anvil having a first edge extending toward said front surface of said disc and being formed to define an array of slots through which at least some of said hammers pass as said disc rotates within said housing;

said first anvil being formed from a series of anvil segments secured together in side-by-side relationship.

2. An apparatus for reducing wood to chips and shards for subsequent processing or disposal as claimed in claim 1 and wherein each of said anvil sections has an edge formed to define a tooth and wherein the teeth of adjacent anvil sections together define said array of slots.

3. An apparatus for reducing wood to chips and shards for subsequent processing or disposal as claimed in claim 1 and wherein said first anvil has a second edge and wherein said second edge is formed to define an array of slots to accommodate passage of hammers whereby said first anvil can be repositioned to present its second edge to said front surface of said disc when said first edge becomes worn or otherwise damaged.

4. An apparatus for reducing wood to chips and shards for subsequent processing or disposal as claimed in claim 1 and further comprising a second anvil secured to said housing, said second anvil having an edge extending toward said front surface of said disc and being formed to define an array of slots through which at least some of said hammers pass as said disc rotates within said housing.

5. The apparatus of claim 4 and wherein said second anvil is oriented at a predetermined angle with respect to said first anvil.

6. The apparatus of claim 5 and wherein said second anvil is oriented at a substantially right angle relative to said first anvil.

7. The apparatus of claim 4 and wherein said first anvil is positioned at the base of said infeed spout.

8. The apparatus of claim 7 and wherein said second anvil is located along a selected edge of said infeed spout.

* * * * *